US010954667B2

(12) United States Patent
Hohmann, Jr. et al.

(10) Patent No.: US 10,954,667 B2
(45) Date of Patent: Mar. 23, 2021

(54) ADJUSTABLE MASONRY ANCHOR

(71) Applicant: Columbia Insurance Company, Omaha, NE (US)

(72) Inventors: Ronald P. Hohmann, Jr., Hauppauge, NY (US); Richard Osmanski, Port Jefferson Station, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 16/585,674

(22) Filed: Sep. 27, 2019

(65) Prior Publication Data

US 2020/0102734 A1 Apr. 2, 2020

Related U.S. Application Data

(60) Provisional application No. 62/737,842, filed on Sep. 27, 2018.

(51) Int. Cl.
*E04B 1/41* (2006.01)

(52) U.S. Cl.
CPC ..... *E04B 1/4185* (2013.01)

(58) Field of Classification Search
CPC ..... E04B 1/4185; F16B 43/00
USPC ..... 52/506.05; 16/2.1
See application file for complete search history.

(56) References Cited

U.S. PATENT DOCUMENTS 4,452,545 A * 6/1984 Colautti ..... E05D 3/022 384/19
5,265,396 A * 11/1993 Amimoto ..... E04F 13/0855 52/745.12
5,619,834 A * 4/1997 Chen ..... E04F 13/0855 52/126.1
5,984,527 A * 11/1999 Kober ..... F16B 5/025 384/192
6,098,364 A * 8/2000 Liu ..... E04F 13/0855 52/235
6,128,883 A * 10/2000 Hatzinikolas ..... E04B 1/4178 52/378
6,212,841 B1 * 4/2001 Plume ..... E04B 1/4178 52/379
7,017,318 B1 * 3/2006 Hohmann ..... E04B 1/4185 52/379
7,908,804 B2 * 3/2011 Vieira ..... E04C 3/02 52/235

(Continued)

*Primary Examiner* — Paola Agudelo
(74) *Attorney, Agent, or Firm* — Stinson LLP

(57) ABSTRACT

An anchor for use in joining inner and outer wythes of the wall. The outer wythe is formed from successive courses of masonry units with a mortar-filled bed joint between each two adjacent courses. The anchor comprises an engagement portion configured for disposition in the bed joint and an attachment portion coupled to the engagement portion. The attachment portion is configured to be secured to the inner wythe. The attachment portion defines an elongate slot. A bushing defines an opening sized and shaped to receive a fastener to attach the attachment portion to the inner wythe. The bushing is movably attached to the attachment portion to permit movement of the bushing and attachment portion relative to one another. This permits the engagement portion to move relative to the outer wythe to position the engagement portion in the bed joint when the fastener secures the attachment portion to the inner wythe.

21 Claims, 11 Drawing Sheets

(56) References Cited

U.S. PATENT DOCUMENTS

| | | | | |
|---|---|---|---|---|
| 8,621,802 | B2 * | 1/2014 | Spyrou | E04B 1/003 52/378 |
| 8,739,485 | B2 | 6/2014 | Hohmann, Jr. | |
| 8,839,587 | B2 | 9/2014 | Hohmann, Jr. | |
| 9,038,350 | B2 | 5/2015 | Hohmann, Jr. | |
| 9,260,855 | B2 * | 2/2016 | Farahmandpour | E04B 1/7616 |
| 9,856,655 | B2 * | 1/2018 | Knight | E04F 13/0807 |
| 10,323,419 | B2 * | 6/2019 | Hatzinikolas | F24S 25/615 |
| 2004/0231270 | A1 * | 11/2004 | Collins | E04B 1/4178 52/506.01 |
| 2012/0191138 | A1 * | 7/2012 | Kiester | A61B 17/8047 606/281 |
| 2013/0232893 | A1 | 9/2013 | Hohmann, Jr. | |
| 2013/0247498 | A1 | 9/2013 | Hohmann, Jr. | |

* cited by examiner

ADJUSTABLE MASONRY ANCHOR

CROSS-REFERENCE TO RELATED APPLICATION

This application claims priority to U.S. Provisional Patent Application No. 62/737,842, filed Sep. 27, 2018, the entirety of which is hereby incorporated by reference.

FIELD

The present disclosure relates to an improved anchoring arrangement for use in conjunction with building construction having a masonry wall secured to an interior wall or support.

BACKGROUND

A facade can be a durable and aesthetically desirable construction for a building exterior. Facades, such as brick or stone veneer walls, also provide protection to the interior of the building from the surrounding environment. Anchoring systems, such as veneer ties, are used to secure facades to inner walls of a building to overcome forces which might pull the facade away from the building. These anchoring systems extend from the inner wall of the building to the facade. Generally, anchoring systems, such as veneer ties are connected to the inner wall with a fastener. When the facade is comprised of bricks, the anchoring systems are generally connected to the facade by positioning portions of the anchoring system in the mortar bed join between bricks. In some instances the application of wall anchors can be made more difficult due to misalignment of the anchors with a mortar bed.

SUMMARY

In one aspect, an anchor for use in a wall to join an inner wythe to an outer wythe of the wall, the outer wythe formed from a plurality of successive courses of masonry units with a mortar-filled bed joint between each two adjacent courses, comprises an engagement portion configured for disposition in the bed joint and an attachment portion coupled to the engagement portion. The attachment portion is configured to be secured to the inner wythe. The attachment portion defines an elongate slot. A bushing defines an opening sized and shaped to receive a fastener to attach the attachment portion to the inner wythe. The bushing is movably attached to the attachment portion to permit movement of the bushing and attachment portion relative to one another. This permits the engagement portion to move relative to the outer wythe to position the engagement portion in the bed joint when the fastener secures the attachment portion to the inner wythe.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
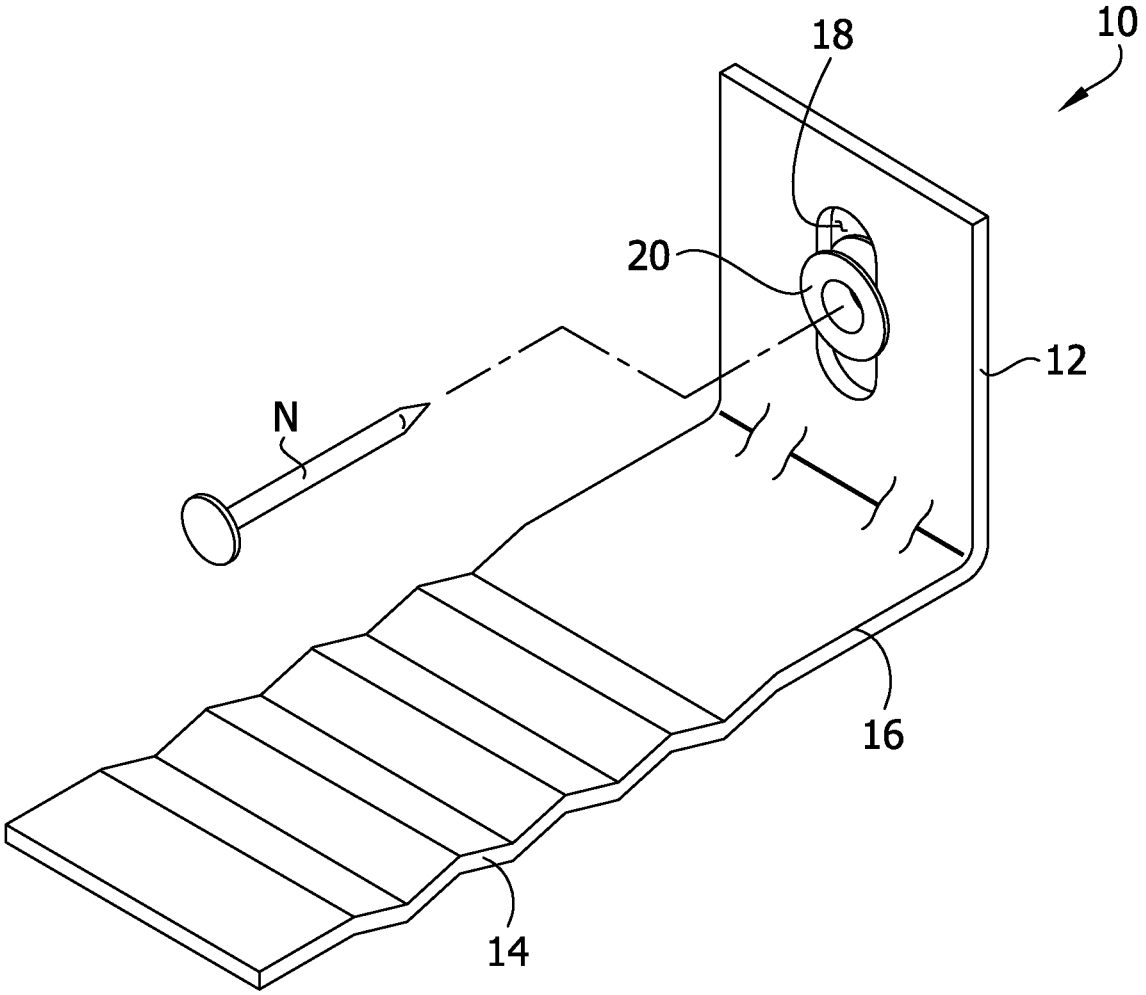
FIG. 1 is a perspective view of a first embodiment of an adjustable anchor having a vertical slot and a round bushing.

Referring now to the drawings and in particular to FIG. 1, a first embodiment of a veneer tie or anchor 10 for connecting an outer wythe (e.g., a veneer or facade) of masonry construction to an interior wythe of a wall (e.g., cavity wall) of a building (not shown) is shown. Cavity walls with a masonry outer wythe are generally known in the art. The outer wythe has successive bed joints (not shown) filled with mortar formed between courses of masonry blocks, such as bricks, masonry or stone. Select bed joints receive the anchor 10 which extends from the bed joint to the inner wythe. The anchor 10 is secured to the inner wythe with a fastener N, such as a nail, screw or bolt. In this way the anchor 10 anchors or secures the outer wythe to the inner wythe. Further details on walls composed of inner and outer wythes may be found in U.S. Pat. No. 10,151,103, the entirety of which is hereby incorporated by reference. They inner and outer wythes may have other constructions than described herein that are within the scope of the present disclosure.

Anchor 10 comprises a piece of material having a generally "L" shape, or more particularly an L-shaped piece of material laid over on its back. The anchor 10 can be formed from one piece of material. The material may be sheet metal or any other suitable material capable of providing a robust connection between the masonry outer wythe and the inner wythe. The anchor 10 can be stamped from the sheet metal and bent into shape. The L-shaped anchor 10 includes an upstanding attachment portion 12 configured to lay flat against an exterior vertical face of the inner wythe. The attachment portion 12 is configured to be attached to the inner wythe. An engagement portion 14 of the anchor 10 is located at an end of the anchor opposite the attachment portion 12. The engagement portion 14 is configured to be received in a mortar bed between vertically adjacent rows of bricks, masonry or stone. A cavity portion 16 extends between and interconnects the attachment portion 12 to the engagement portion 14. Generally, the cavity portion 16 is configured to extend through the cavity or space between the inner and outer wythes. However, in some uses, at least a portion of the cavity portion 16 may be embedded in the mortar bed joint. In the illustrated embodiment, the engagement portion 14 is corrugated to augment its grip of the mortar in the mortar bed joint to resist pull out. However, other ways to form the engagement portion 14 to resist pull out may be used within the scope of the present disclosure. Moreover, the corrugation could be eliminated.

Attachment of the anchor 10 to the interior wall is facilitated by the provision of an elongate slot 18 in the attachment portion 12. A bushing 20 of the anchor 10 is received in the slot 18. Preferably, the bushing 20 is permanently secured in the slot 18. In FIG. 1, the bushing 20 has the shape of a rivet or tire rim, having a pair of larger diameter flanges connected by a narrower neck that is received through the slot 18 and connects the flanges to each other. In other words, the bushing 20 defines a circumferential channel or groove which receives edges of the attachment portion 12 defining the slot 18 to secure the bushing within the slot. In other embodiments, the bushing 20 may only include one larger diameter flange that engages and presses against the attachment portion 12. The bushing 20 is movable within (e.g., along) the slot 18. The relative size of the neck of the bushing 20 and the width of the slot 18 is such that the bushing may be slid up and down along the slot over its full height. The center of the bushing 20 has a through hole that permits a suitable fastener N, such as a nail, to pass through the bushing to be driven into the inner wythe to connect the anchor 10 to the inner wythe. Among other suitable fasteners that could be used are screws or bolts (not shown). The provision of the elongate slot 18 and bushing 20 allows for vertical adjustment of the engagement portion 14 in use. This allows the engagement portion 14 to be located at the right position in the mortar bed joint without bending or otherwise contorting the anchor 10. Although the anchor is illustrated in a position in which the engagement portion 14 and cavity portion 16 generally lie in a horizontal plane extending from a bottom edge of the attachment portion 12, other orientations of the anchor 10 in use are possible. For example, the anchor 10 could be inverted from the position shown in FIG. 1, or less commonly, arranged at any orientation between the illustrated and inverted positions.

When the anchor 10 is attached to the inner wythe, the engagement portion 14 extends into the bed joint of the outer wythe. The attachment portion 12 lies generally flat against the inner wythe, while the engagement and cavity portions 14, 16 extend generally horizontally to the outer wythe. The engagement and cavity portions 14, 16 may have different lengths to accommodate walls of various constructions. When the engagement portion 14 is inserted into the outer wythe, the insertion portion is in a substantially horizontal plane with the bed joint. At least a portion of the engagement portion 14 is surrounded by the mortar and secured within the bed joint. In one embodiment, the anchor 10 has a width of about 1 inch (2.5 cm), a height of 1.5 inches (3.8 cm) and a length of 4.25 inches (10.8 cm), although other dimensions and proportions are within the scope of the present disclosure.

Figure 2:
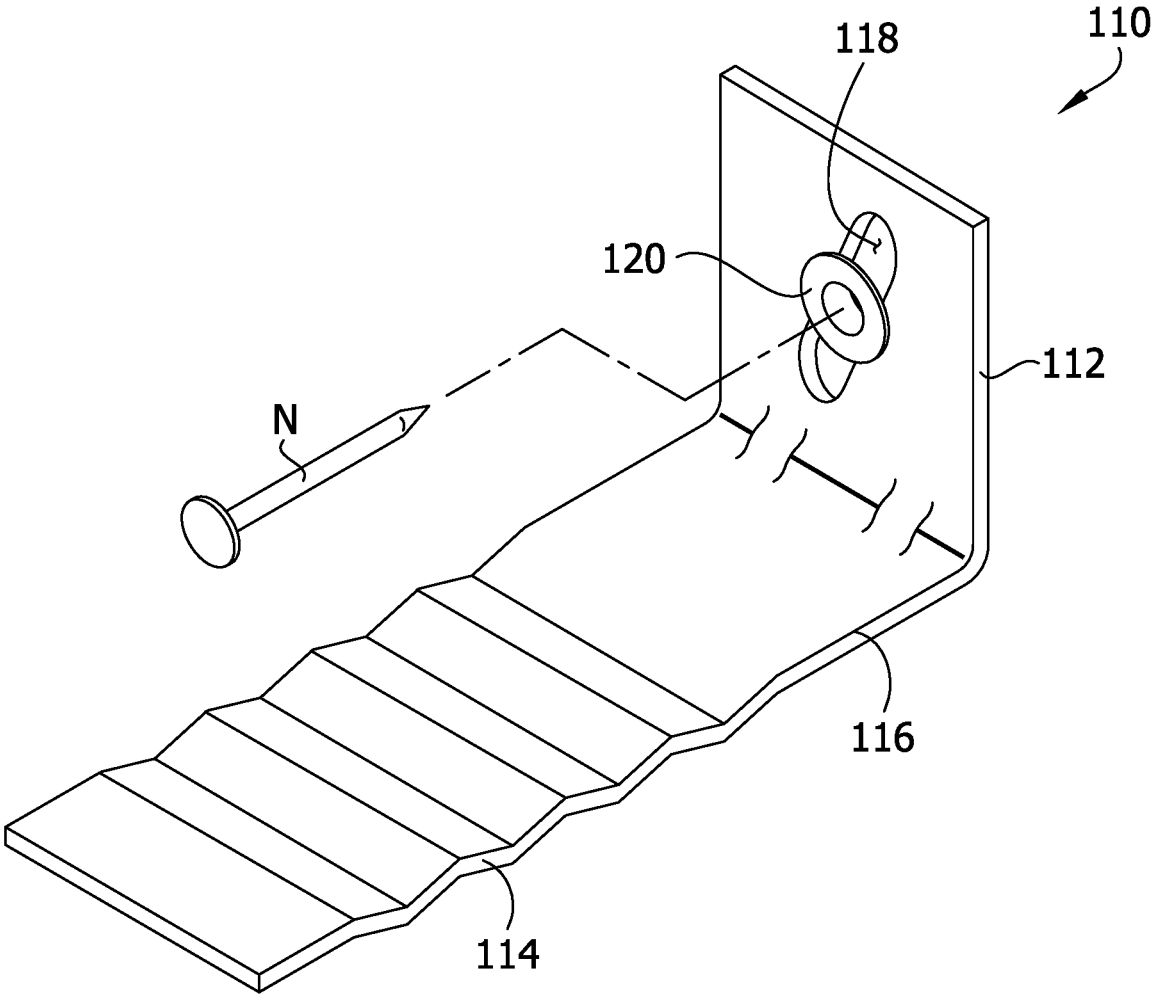
FIG. 2 is a perspective view of a second embodiment of an adjustable anchor having an angled slot and a round bushing.

Referring to FIG. 2, a second embodiment of an anchor 110 is shown. The anchor 110 has essentially the same construction as the anchor 10 of FIG. 1, but the slot 118 is angled relative to the vertical (e.g., at a 45° angle). The angulation of the slot 118 permits some horizontal adjustment of the anchor 110 along with vertical adjustment. It will be appreciated that the slot may have other angles than shown in FIG. 2 within the scope of the present disclosure. As one example, and without limitation, the slot 118 could include a horizontal section and a vertical section in communication with each other allowing for both horizontal and/or vertical adjustment. There could also be more than one vertical slot and/or more than one horizontal slot.

Figure 3:
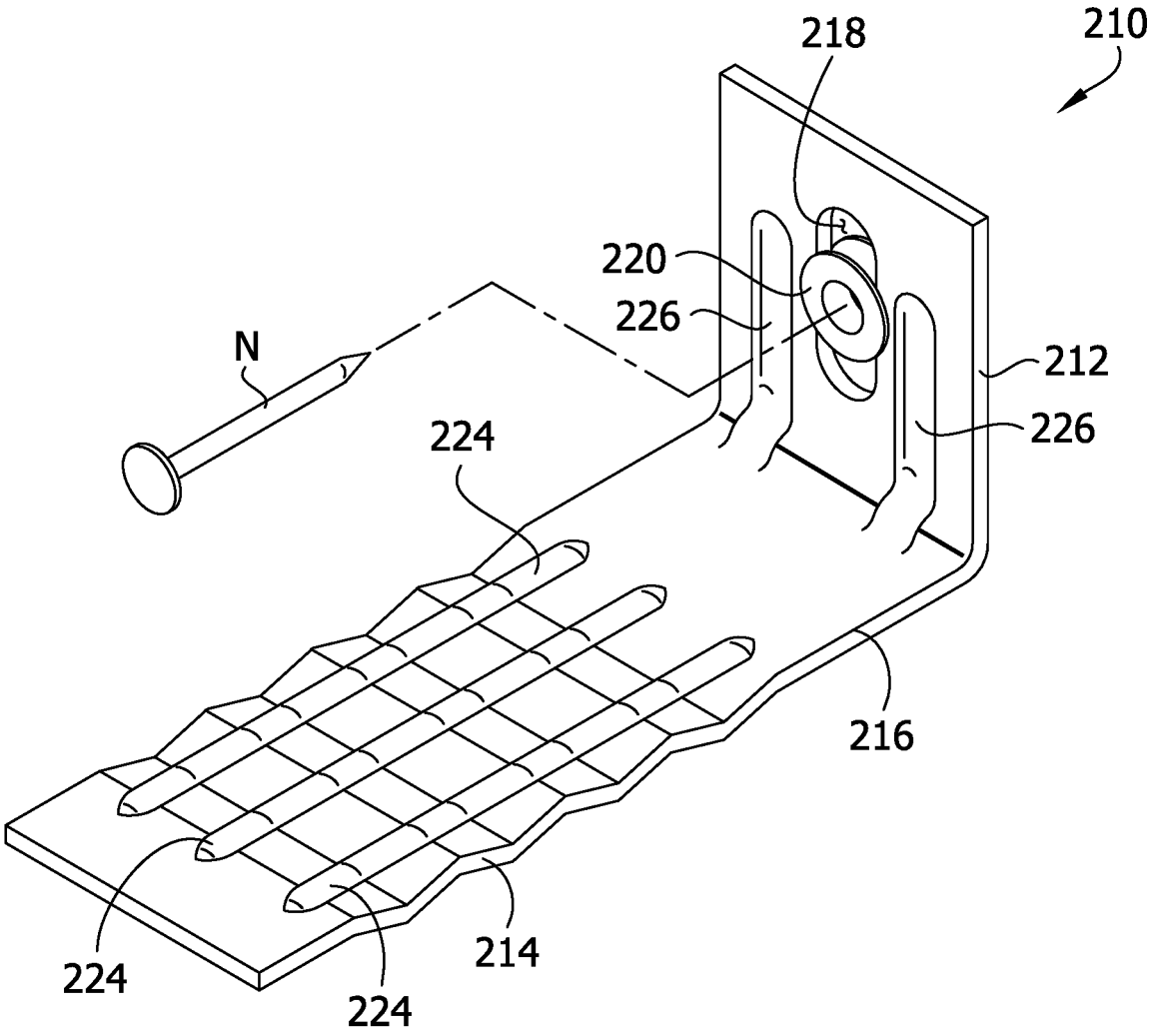
FIG. 3 is a perspective of a third embodiment of an adjustable anchor similar to FIG. 1, but having additional strength features.

Referring to FIG. 3, a third embodiment of an anchor 210 is shown. The anchor 210 has essentially the same construction as the anchor 10 of FIG. 1, but includes additional strength features. The material of the anchor is deformed or otherwise made to include first ribs 224 extending lengthwise of the engagement portion 214 and cavity portion 216. Although three ribs 224 are shown any number and arrangement of first ribs may be used. Second ribs 226 are located on the attachment portion 212 and may extend through the bend of the material between the attachment portion and the cavity portion 216. Two second ribs 226 on either side of the slot 218 are shown in FIG. 3, but any number and arrangement of second ribs may be used. The first and second ribs 224, 226 help to increase the stiffness of the anchor 210.

Furthermore, the second ribs 226 facilitate the movement of the anchor 210 relative to the inner wythe once the anchor is secured to the inner wythe with the fastener N. When the anchor 210 is mounted on the inner wythe, the second ribs 226 extend toward (e.g., rearward) and engage an exterior surface of the inner wythe. The fastener N compresses the attachment portion 212 against the inner wythe, securing the anchor 210 to the inner wythe. Specifically, the fastener N pushes the bushing 220 against the attachment portion 212. As a result, the second ribs 226 of the adjustment portion 212 engage the exterior surface of the inner wythe. The second ribs 226 outwardly offset (e.g., space apart) the rest of the adjustment portion 212 from the exterior surface of the inner wythe to prevent the peripheral edges of the adjustment portion from deforming the inner wythe such as by tearing a moisture barrier (not shown), such as asphalt paper, that typically forms the exterior surface of the inner wythe, as the adjustment portion is moved to adjust the position of the anchor 210, as mentioned above. Preferably, the second ribs 226 are rounded to allow the ribs to slide over the exterior surface, without tearing the moisture barrier. In other embodiments, the second ribs 226 may extend away (e.g., forward) from the inner wythe such that the second ribs do not engage the inner wythe.

Figure 4:
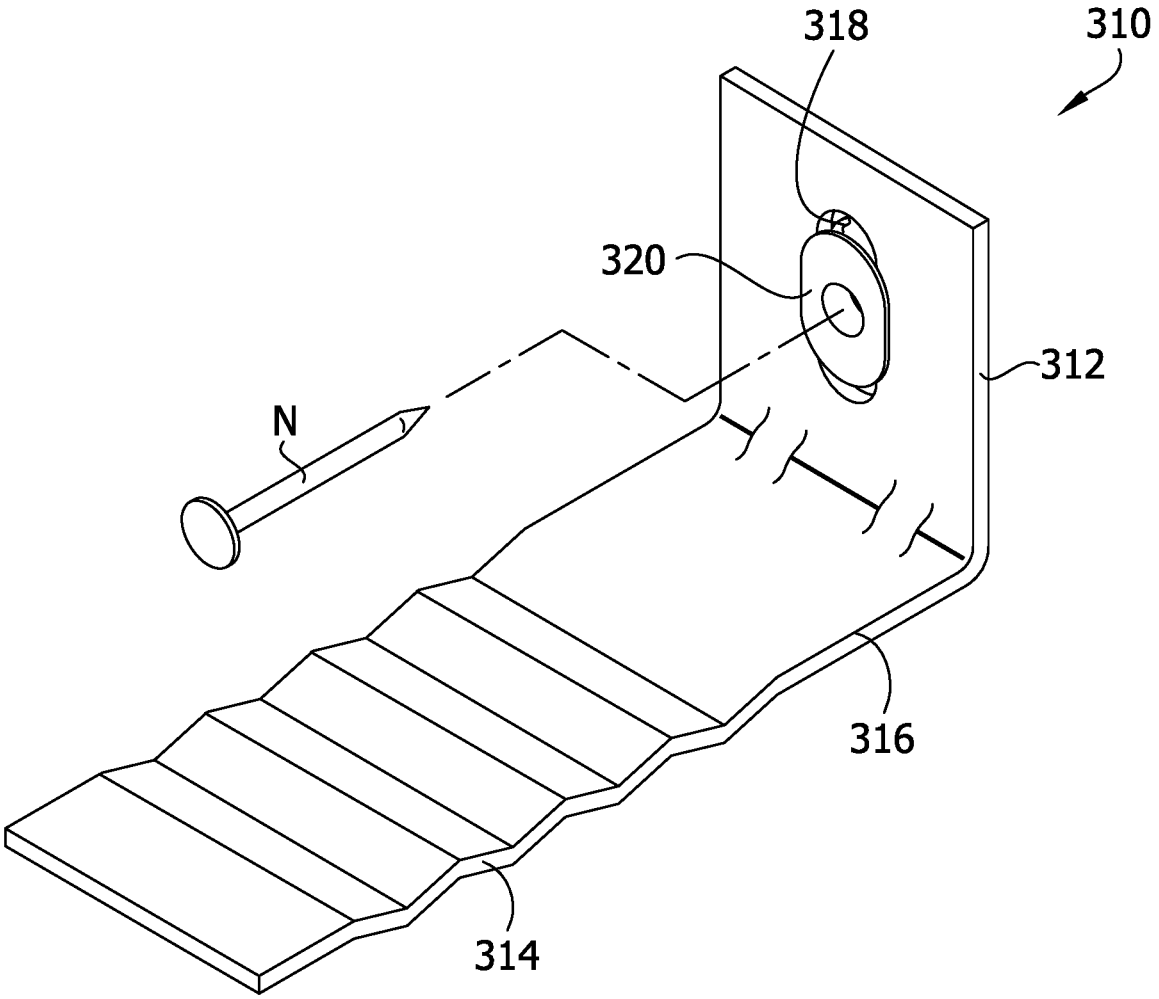
FIG. 4 is a perspective of a fourth embodiment of an adjustable anchor having an vertical slot and an elongate bushing.

Referring to FIG. 4, a fourth embodiment of an anchor 310 is shown. The anchor 310 has essentially the same construction and the anchor 10 of FIG. 1, but in this case the bushing 320 is elongated in a direction extending along the length of the slot 318. In some versions of the FIG. 4 embodiment, the bushing 320 has a corresponding elongated neck that inhibits turning or rotating of the L-shaped piece about the bushing.

Figure 5:
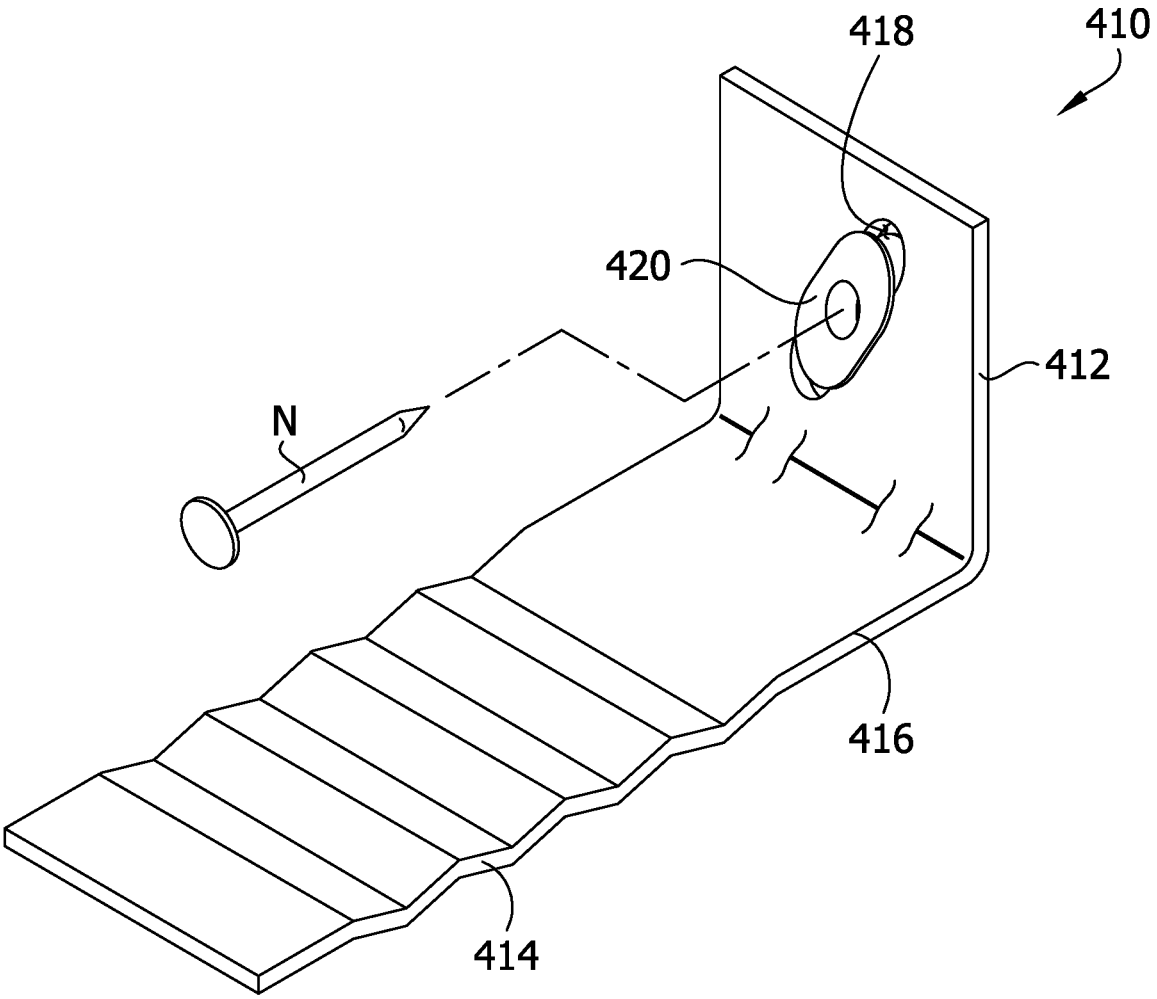
FIG. 5 is a perspective of a fifth embodiment of an adjustable anchor having an angled slot and an elongate bushing.

Referring to FIG. 5, a fifth embodiment of an anchor 410 is shown. The anchor 410 has a similar construction to the anchor 110 of FIG. 2, except that the bushing 420 has the elongate configuration as shown for the FIG. 4 embodiment.

Figure 6:
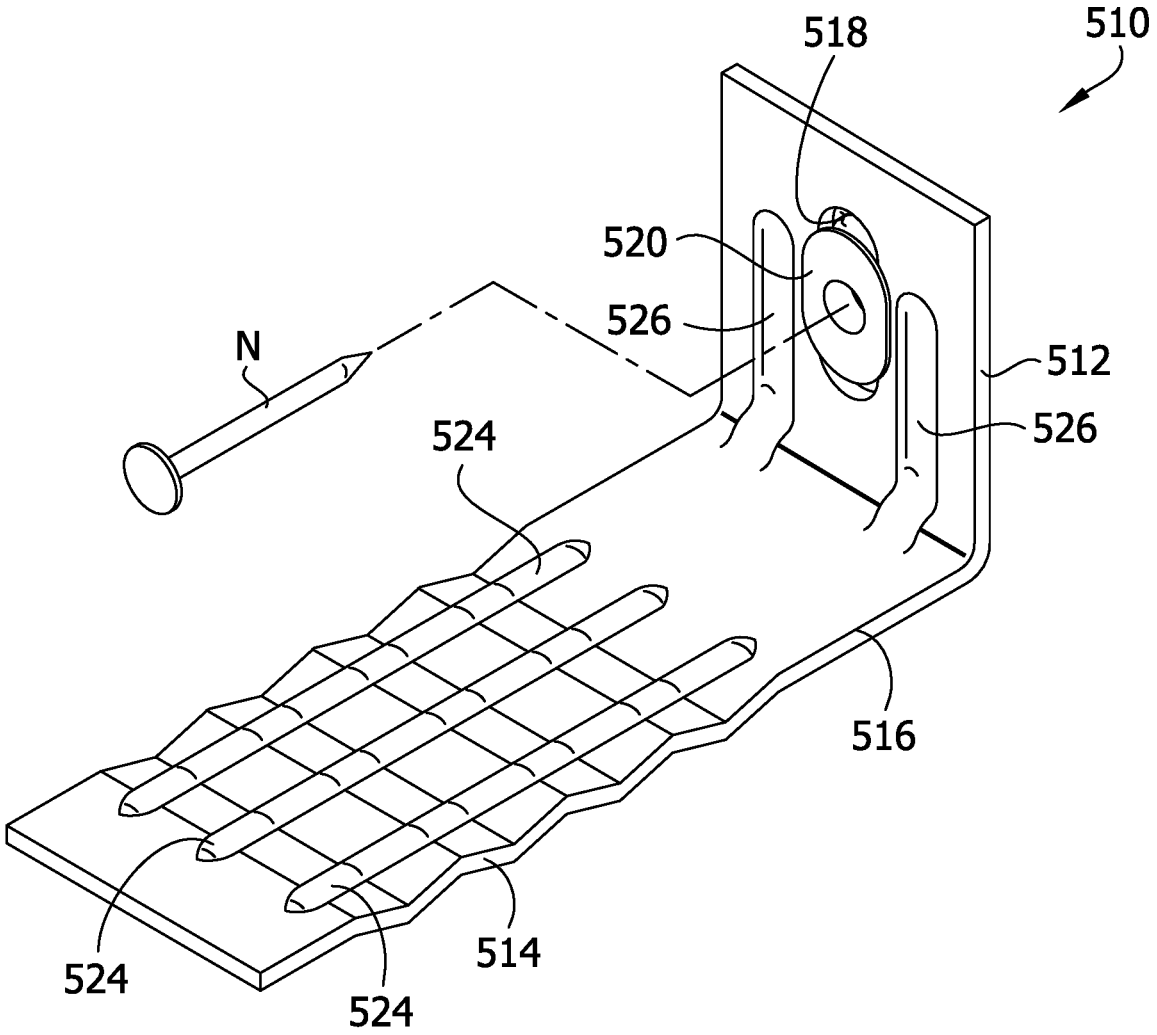
FIG. 6 is a perspective of a sixth embodiment of an adjustable anchor similar to FIG. 4, but having additional strength features.

Referring to FIG. 6, a sixth embodiment of an anchor 510 is shown. The anchor 510 is of the same construction as the anchor 310 of FIG. 4, but has additional strength features. More particularly, the anchor 510 has first ribs 524 and second ribs 526 as described above in relation to FIG. 3.

Figure 7:
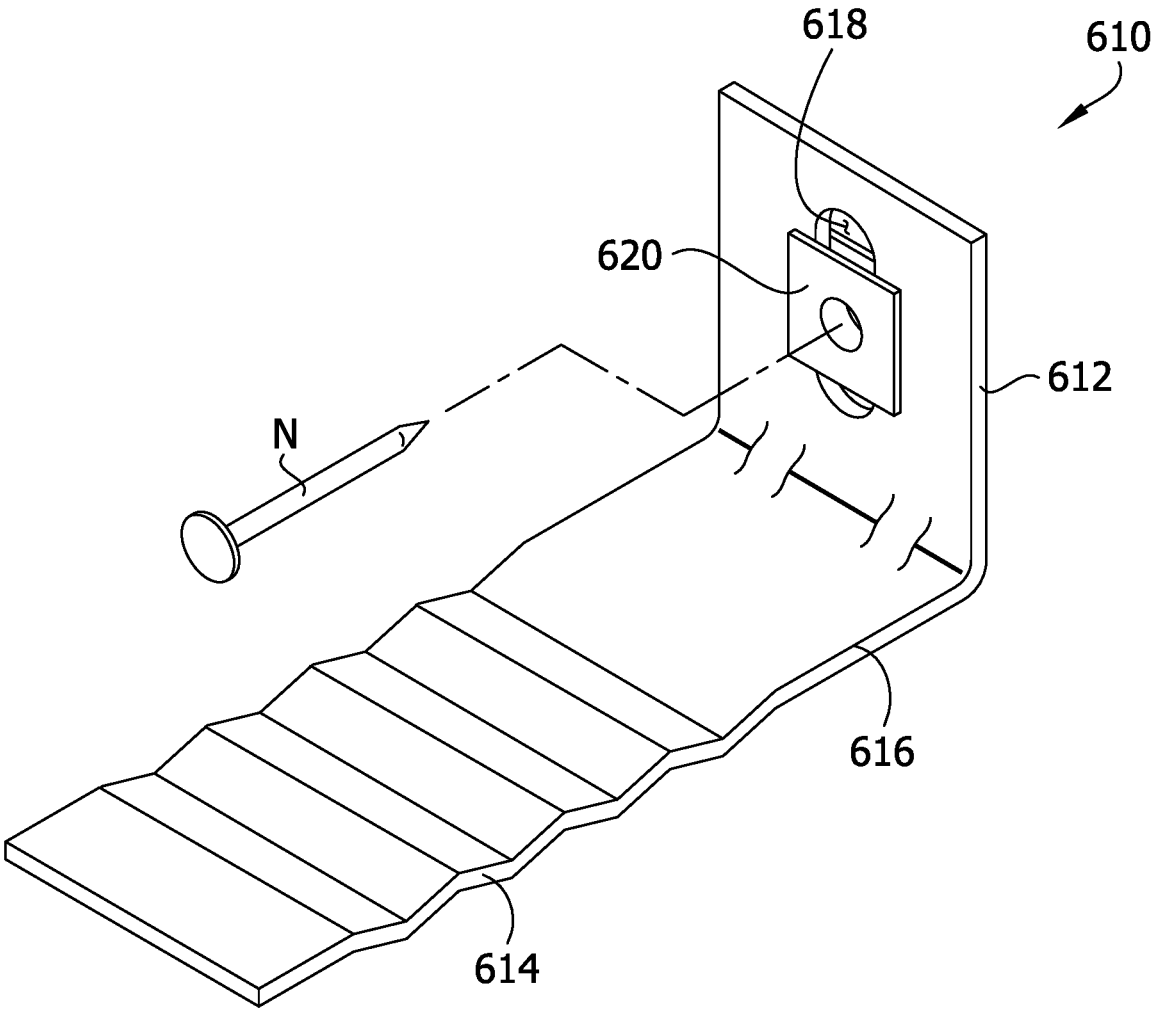
FIG. 7 is a perspective of a seventh embodiment of an adjustable anchor having a vertical slot and a square bushing.

Referring to FIG. 7, a seventh embodiment of an anchor 610 is shown. The anchor 610 that has the same construction as the anchor 10 of FIG. 1, but has a square bushing 620. As shown, the flanges of the bushing 620 are square. A neck of the bushing 620 may be round, elongate or rectangular. A rectangular or elongate neck prevents relative rotation of the anchor 610 and the bushing 620.

Figure 8:
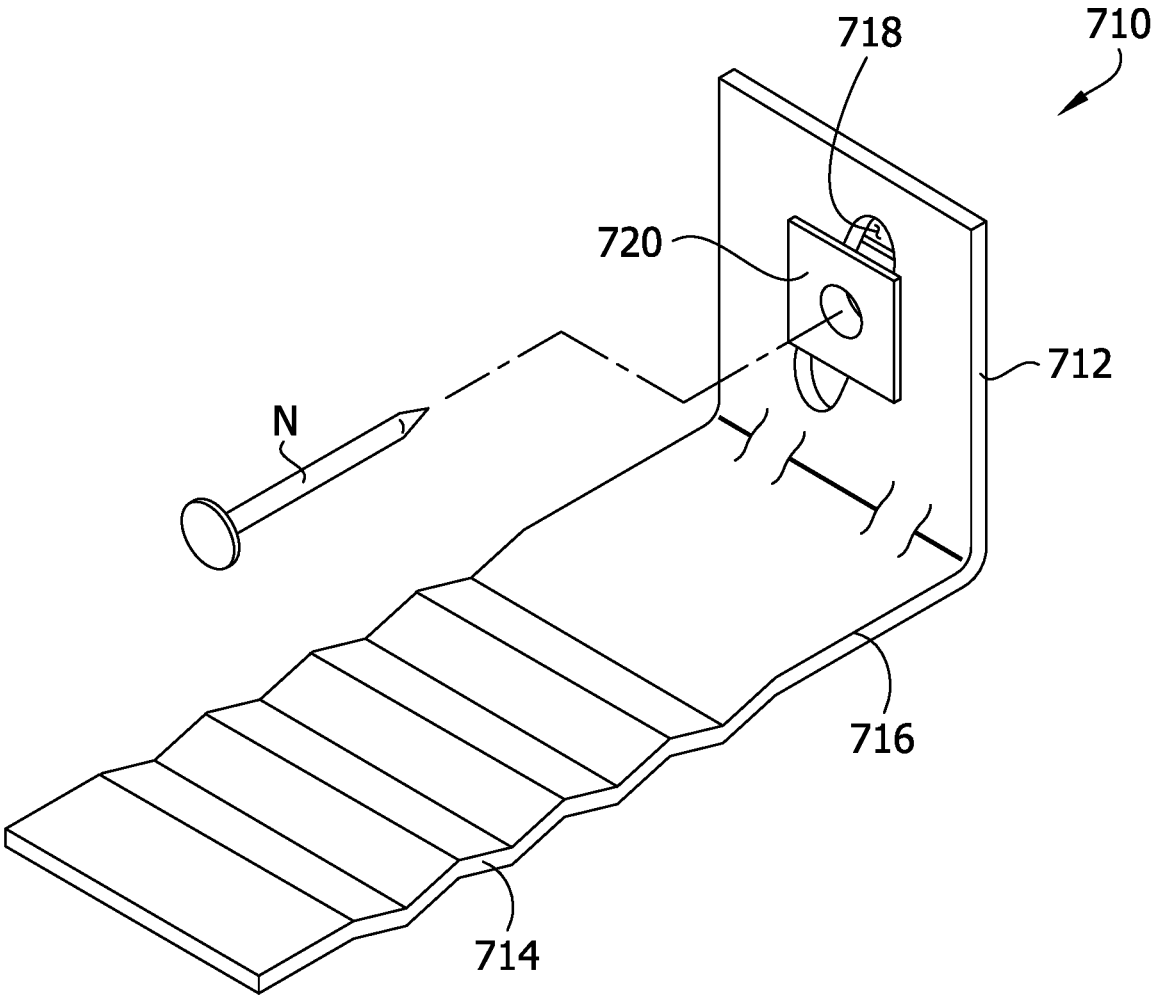
FIG. 8 is a perspective of a eighth embodiment of an adjustable anchor having an angled slot and a square bushing.

Referring to FIG. 8, an eighth embodiment of an anchor 710 is shown. The anchor 710 has the same construction as the anchor 110 of FIG. 2, with an angled slot 718. However, a square bushing 720 like the bushing 620 of FIG. 7 is employed.

Figure 9:
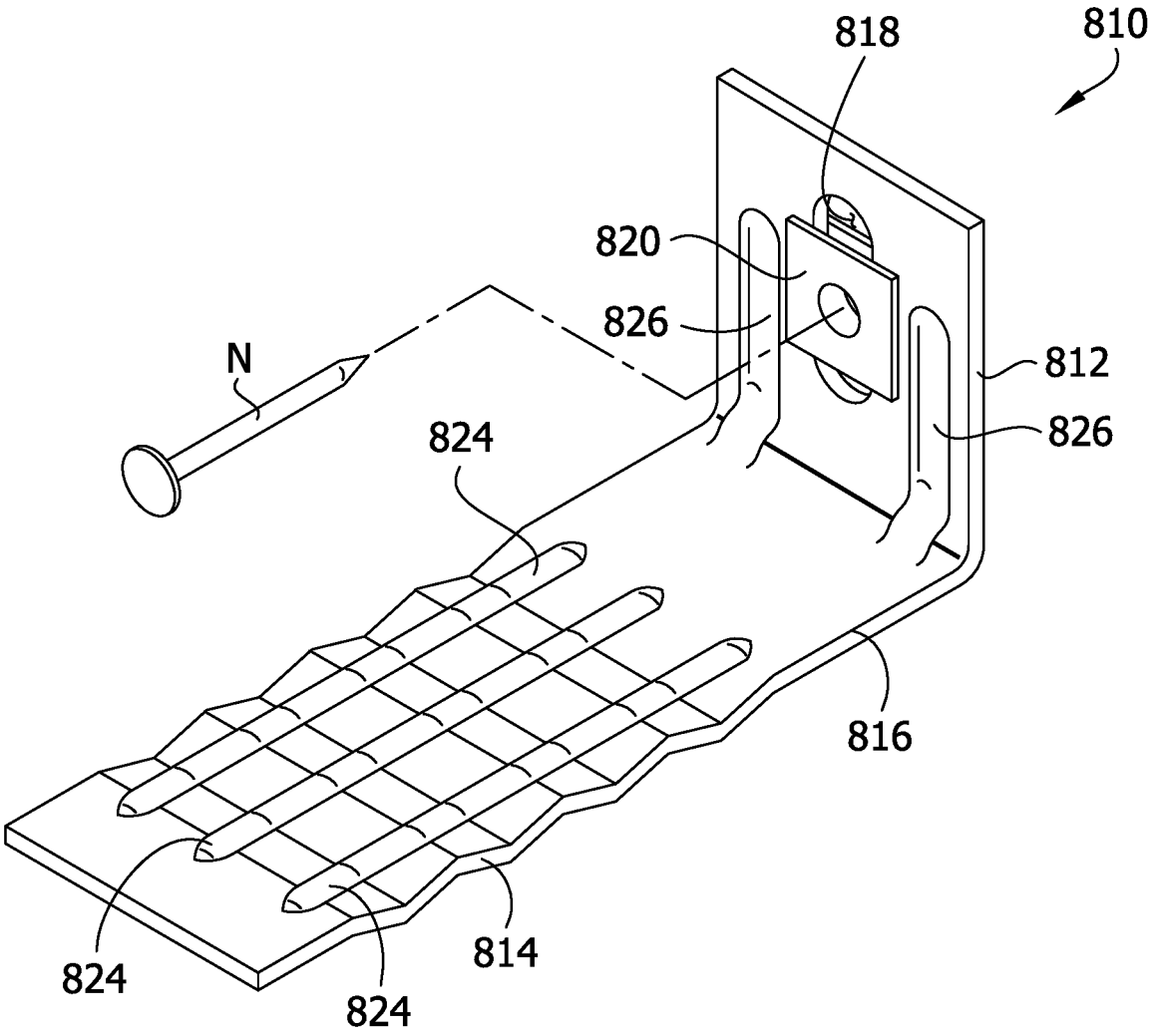
FIG. 9 is a perspective of a ninth embodiment an adjustable anchor similar to FIG. 7, but having additional strength features.

Referring to FIG. 9, a ninth embodiment of an anchor 810 is shown. The anchor 810 has the same construction as the anchor 610 of FIG. 7, but includes additional strength features in the form of first ribs 824 and second ribs 826, as described above in relation to the anchor 210 of FIG. 3.

Figure 10:
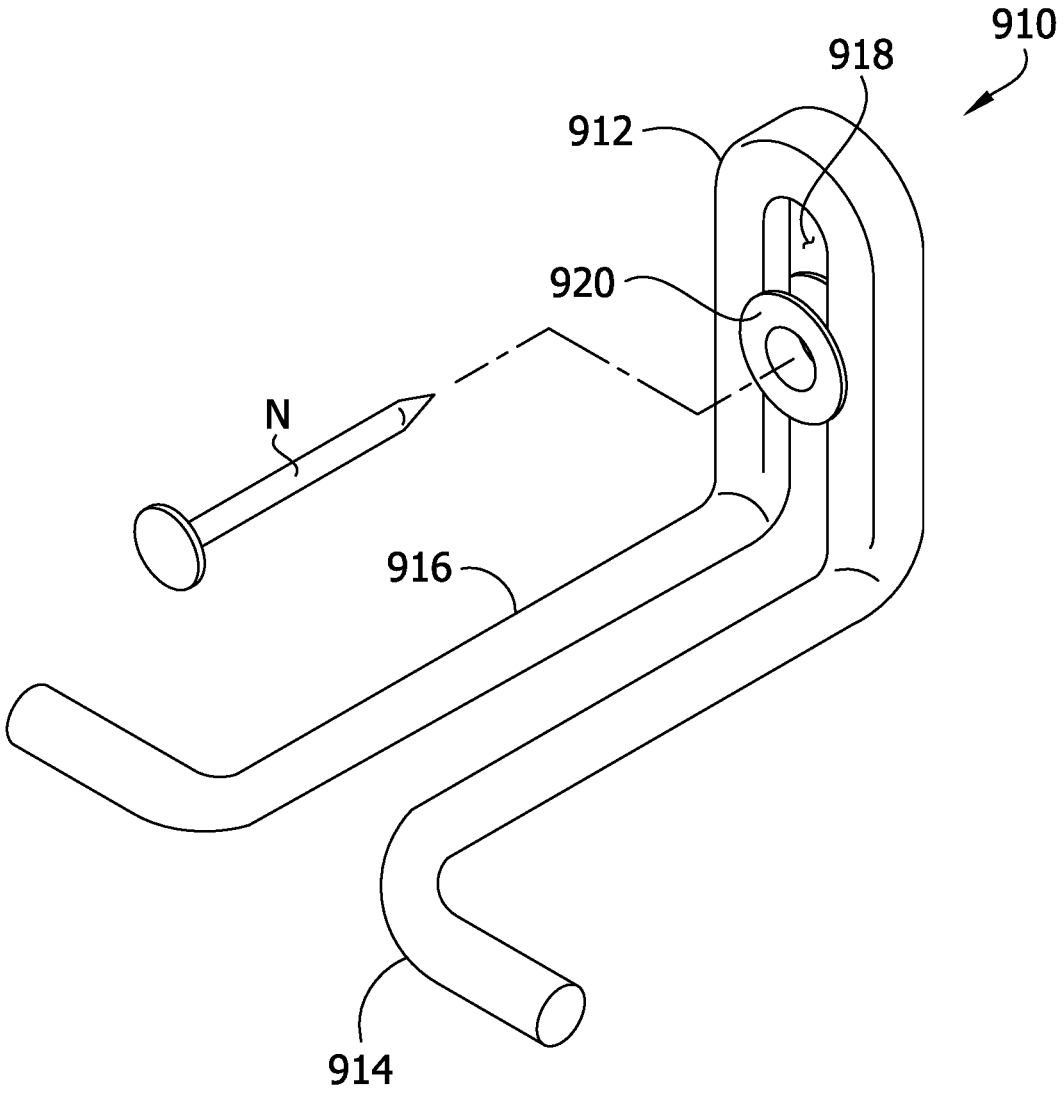
FIG. 10 is a perspective of a tenth embodiment of an adjustable anchor having a round bushing and a wire formative shape.

Referring to FIG. 10, a tenth embodiment of an anchor 910 is shown. In this embodiment, the anchor 910 is a wire formative. The wire form anchor 910 includes an attachment portion 912, an engagement portion 914 and a cavity portion 916. The anchor 910 is made from a length of wire that is bent into shape. The attachment portion 912 comprises a segment of the wire that is bent into an inverted-U. The legs and connecting base of the U-shaped attachment portion 912 define a vertical slot 918 that receives a round bushing 920 that may slide up and down in the slot to permit vertical adjustment of the anchor 910. The attachment portion 912 is shown to be compressively reduced so that it has relatively flat forward and rearward facing surfaces on which the flanges of the bushing 920 may ride. Compressive reduction of the anchor 910 may be used in other locations or entirely omitted within the scope of the present disclosure. The cavity portion 916 is formed by two parallel segments of the wire extending forward of the bottom of the attachment portion 912. The wire segments forming the cavity portion 916 are spaced apart a distance less than the diameter of the flanges forward flange of the bushing 920 so that the bushing will not fall out of the slot 918 (e.g., the slot is open ended). The wire may be formed in other ways to hold the bushing 920 in the slot 918. The engagement portion 914 includes two segments of the wire that have been bent outward to extend in opposite directions from each other generally in a horizontal plane. The engagement portion 914 may also include a parts of the straight segments that also define the cavity portion 916, which parts are received into the mortar bed in use. It will be understood that the wire form anchor 910 may have other configurations within the scope of the present disclosure. Further details on the anchor 910 may be found in U.S. patent application Ser. No. 16/173,969, the entirety of which is hereby incorporated by reference.

Figure 11:
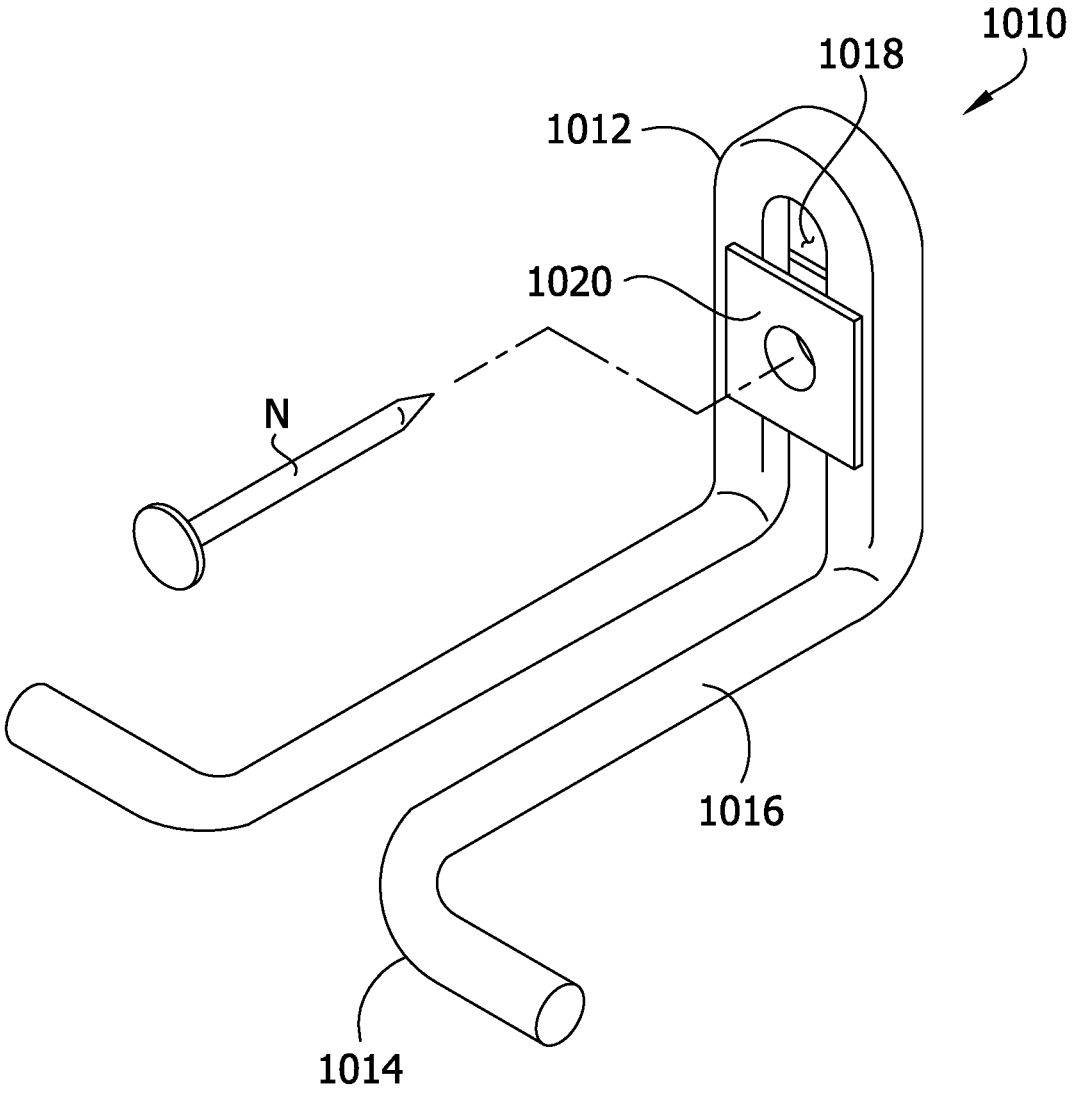
FIG. 11 is a perspective of an eleventh embodiment of an adjustable anchor similar to FIG. 10, but having a square bushing.

Referring to FIG. 11, an eleventh embodiment of an anchor 1010 is shown. The anchor 1010 has the same construction as the anchor 910 of FIG. 10 except that a square bushing 1020 is used. The person of ordinary skill in the art will appreciate that the bushing 1020 may have other shapes, including but not limited to the elongate bushing shown in FIG. 4 and elsewhere.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

For ease of comprehension, where similar or analogous elements are used, corresponding reference numerals are employed. For example attachment portion 12 is similar or analogous to attachment portion 112.

Having described the invention in detail, it will be apparent that modifications and variations are possible without departing from the scope of the invention defined in the appended claims. For example, where specific dimensions are given, it is understood these dimensions are illustrative and other dimensions are within the scope of the present disclosure.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. An anchor for use in a wall to join an inner wythe to an outer wythe of the wall, the outer wythe formed from a plurality of successive courses of masonry units with a mortar-filled bed joint between each two adjacent courses, the anchor comprising:

an engagement portion configured for disposition in the bed joint;

an attachment portion coupled to the engagement portion and configured to be secured to the inner wythe, the attachment portion defining an elongate slot; and a bushing defining an opening sized and shaped to receive a fastener to attach the attachment portion to the inner wythe, the bushing being movably attached to the attachment portion to permit movement of the bushing and attachment portion relative to one another so that the engagement portion can move relative to the outer wythe to position the engagement portion in the bed joint when the fastener secures the attachment portion to the inner wythe, the bushing including a having a front flange and a rear flange, the front and rear flanges defining a groove, at least a portion of the attachment portion being received in the groove such that the front flange is disposed in front of the attachment portion and the rear flange is disposed rearward of the attachment portion.

2. The anchor of claim 1, wherein the attachment portion defines an elongate slot, the bushing being slidably disposed within the elongate slot.

3. The anchor of claim 2, wherein the elongate slot extends generally vertically.

4. The anchor of claim 2, wherein the elongate slot extends at an angle to the vertical.

5. The anchor of claim 4, wherein the elongate slot extends at about a 45 degree angle to the vertical.

6. The anchor of claim 2, wherein the bushing is shaped to inhibit the bushing and attachment portion from rotating relative to one another.

7. The anchor of claim 1, wherein the bushing is round.

8. The anchor of claim 1, wherein the bushing is rectangular.

9. The anchor of claim 1, wherein the engagement portion and the attachment portion are formed as one piece of material.

10. The anchor of claim 9, wherein the engagement portion and the attachment portion are formed from sheet metal.

11. The anchor of claim 9, wherein the engagement portion and the attachment portion are formed of wire.

12. The anchor of claim 11, wherein at least a portion of the wire is compressively reduced.

13. The anchor of claim 12, wherein at least the portion of the wire forming the attachment portion is compressively reduced.

14. The anchor of claim 1, wherein the engagement portion is corrugated.

15. The anchor of claim 1, further comprising a cavity portion interconnecting the engagement and attachment portions.

16. The anchor of claim 1, wherein the engagement portion includes at least one rib configured to stiffen the engagement portion.

17. The anchor of claim 1, wherein the attachment portion includes at least one rib configured to stiffen the attachment portion.

18. The anchor of claim 17, wherein the at least one rib is configured to engage the inner wythe upon mounting the anchor on the inner wythe, the at least one rib configured to space peripheral edge margins of the attachment portion from the inner wythe upon mounting the anchor on the inner wythe to prevent the peripheral edge margins from deforming the inner wythe when attachment portion is moved relative to the bushing.

19. The anchor of claim 1, wherein the engagement and attachment portions form an L-shape.

20. An anchor for use in a wall to join an inner wythe to an outer wythe of the wall, the outer wythe formed from a plurality of successive courses of masonry units with a mortar-filled bed joint between each two adjacent courses, the anchor comprising:

an engagement portion configured for disposition in the bed joint;

an attachment portion coupled to the engagement portion and configured to be secured to the inner wythe, the attachment portion defining an elongate slot; and a bushing defining an opening sized and shaped to receive a fastener to attach the attachment portion to the inner wythe, the opening defining an axis, the bushing being movably attached to the attachment portion to permit movement of the bushing and attachment portion relative to one another so that the engagement portion can move relative to the outer wythe to position the engagement portion in the bed joint when the fastener secures the attachment portion to the inner wythe, the bushing being shaped to engage the attachment portion to inhibit rotation of the bushing about the axis relative to the attachment portion.

21. An anchor for use in a wall to join an inner wythe to an outer wythe of the wall, the outer wythe formed from a plurality of successive courses of masonry units with a mortar-filled bed joint between each two adjacent courses, the anchor comprising:

an engagement portion configured for disposition in the bed joint;

an attachment portion coupled to the engagement portion and configured to be secured to the inner wythe, the attachment portion defining an elongate slot, the attachment portion including at least one rib configured to stiffen the attachment portion; and a bushing defining an opening sized and shaped to receive a fastener to attach the attachment portion to the inner wythe, the bushing being movably attached to the attachment portion to permit movement of the bushing and attachment portion relative to one another so that the engagement portion can move relative to the outer wythe to position the engagement portion in the bed joint when the fastener secures the attachment portion to the inner wythe;

wherein the at least one rib is configured to engage the inner wythe upon mounting the anchor on the inner wythe, the at least one rib configured to space peripheral edge margins of the attachment portion from the inner wythe upon mounting the anchor on the inner wythe to prevent the peripheral edge margins from deforming the inner wythe when attachment portion is moved relative to the bushing.

* * * * *